US006019049A

United States Patent [19]

Gaydos et al.

[11] Patent Number: 6,019,049

[45] Date of Patent: Feb. 1, 2000

[54] RAILROAD HOPPER CAR DOOR ASSEMBLY

[75] Inventors: Christopher C. Gaydos, Aurora; Robert T. Fischer, Homewood; Guadalupe L. Galvan, Dekalb, all of Ill.

[73] Assignee: Miner Enterprises, Inc., Geneva, Ill.

[21] Appl. No.: 09/088,569

[22] Filed: Jun. 2, 1998

[51] Int. Cl.[7] ..... B61D 3/00

[52] U.S. Cl. ..... 105/289; 105/250; 105/299

[58] Field of Search ..... 105/240, 248, 105/250, 279, 280, 284, 286, 287, 288, 289, 290, 296, 299, 311.1, 313; 298/27, 29, 31, 33, 34, 35 R, 35 M

[56] References Cited

U.S. PATENT DOCUMENTS

| | | | |
|---|---|---|---|
| 3,161,146 | 12/1964 | Lutts et al. | 105/286 |
| 3,182,954 | 5/1965 | Borger | 251/203 |
| 3,501,030 | 3/1970 | Flink | 105/287 |
| 3,772,996 | 11/1973 | Schuller | 105/240 |
| 3,818,842 | 6/1974 | Heap | 105/290 |
| 4,232,989 | 11/1980 | Muller | 414/387 |
| 4,250,814 | 2/1981 | Stark et al. | 105/240 |
| 4,266,486 | 5/1981 | Puariea | 105/276 |
| 4,370,819 | 2/1983 | Ingram | 37/104 |
| 4,371,208 | 2/1983 | Stricker | 298/23 |
| 4,389,149 | 6/1983 | Dancs | 414/382 |
| 4,401,242 | 8/1983 | Bonomo | 222/533 |
| 4,407,202 | 10/1983 | McCormick | 105/271 |
| 4,449,646 | 5/1984 | Bonerb et al. | 222/95 |
| 4,494,798 | 1/1985 | Bailey | 298/17.6 |
| 4,766,820 | 8/1988 | Ritter et al. | 105/240 |
| 5,115,748 | 5/1992 | Westlake | 105/299 |

*Primary Examiner*—Mark T. Le
*Attorney, Agent, or Firm*—John W. Harbst

[57] ABSTRACT

A discharge door assembly for a bottom dump covered railroad hopper car is provided. The discharge door assembly includes a plurality of longitudinally mounted discharge doors arranged in end-to-end relation across a bottom of the hopper car; with each discharge door being movable between open and closed positions about a pivot axis disposed parallel to and adjacent a longitudinal axis of the hopper car. A door operating mechanism including a single powered actuator operates all of the discharge doors substantially simultaneously to effect rapid discharge of matter from the hopper with significantly less operator involvement. The door operating mechanism further includes a lock for releasably holding the discharge doors in a closed position. A venting system inhibits imploding of the walls of the hopper car upon discharge of particulate matter from the car. Deflectors are arranged on opposite sides of the hopper car to combine with the pivoted discharge doors in limiting the discharge pattern of material from the hopper car to a relatively narrow pattern or stream disposed between the rails on which the hopper car moves.

37 Claims, 9 Drawing Sheets

FIG. 9
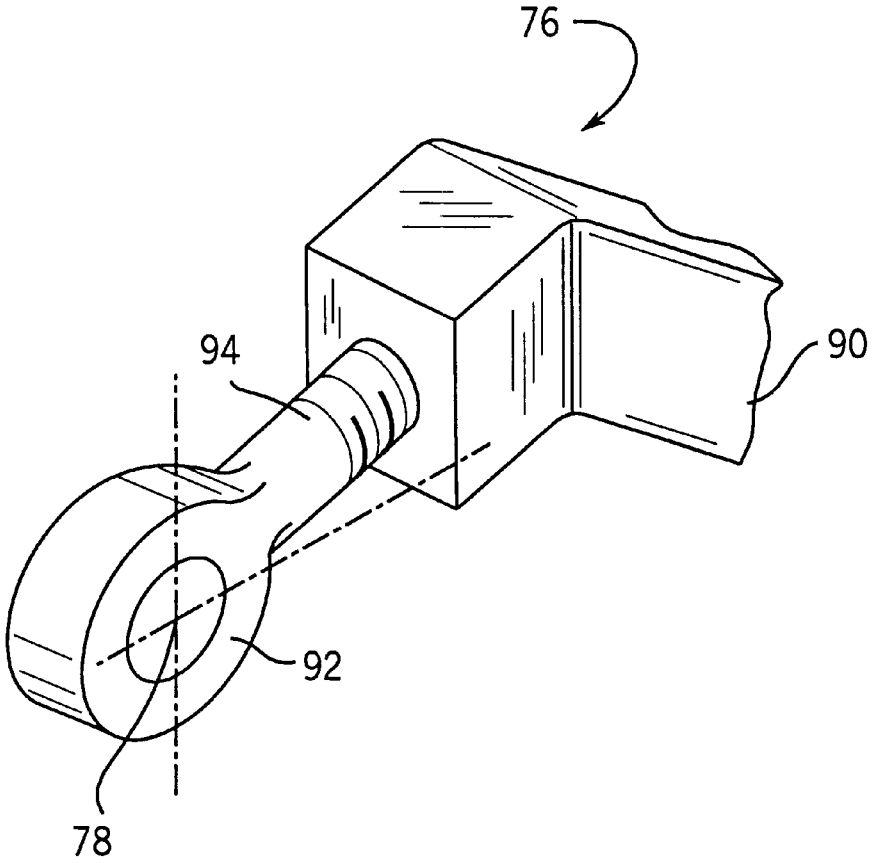
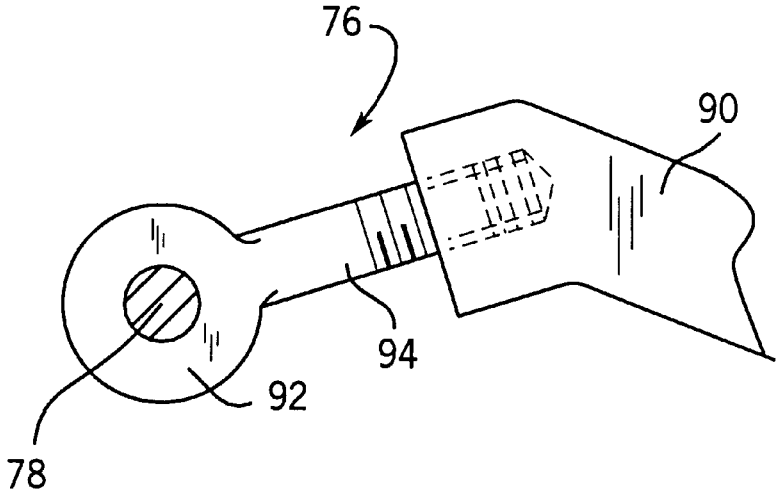
FIG. 10

RAILROAD HOPPER CAR DOOR ASSEMBLY

FIELD OF THE INVENTION

The present invention generally relates to hopper cars and, more particularly, to a door assembly mounted longitudinally to a bottom of a railroad hopper car to control the discharge of ballast and/or particulate matter from the hopper car.

BACKGROUND OF THE INVENTION

Covered railroad hopper cars typically include a walled enclosure mounted on an underframe of the car. As is conventional, the underframe of the car is supported toward opposite ends thereof by the usual wheeled trucks which ride on tracks or rails. A bottom of the walled enclosure is usually provided with a series, typically one or more, individual discharge openings for allowing the particulate matter held and transported within the enclosure to be discharged therefrom. The walled enclosure furthermore usually includes sloped or slanted walls or sheets extending upwardly from the periphery of each discharge opening to promote gravitational movements of the particulate matter toward the openings.

Various methods and devices are known in the art for individually closing the plurality of discharge openings in the walled enclosure of the hopper car. A slide gate mechanism is typically used in combination with each individual discharge opening on the hopper car. A conventional slide gate mechanism or device includes a frame which is bolted or otherwise connected to the walled enclosure on the hopper car. The frame defines an opening which, when the gate is assembled to the hopper car, is in registry with the discharge opening on the hopper car thereby permitting particulate matter to pass therethrough. A gate is arranged on the frame for sliding movement between open and closed positions relative to the discharge opening. When open, the gate permits the contents of the hopper car to gravitationally pass from the car. When closed, the sliding gate shuts off the matter or material flow through the gate. Typically, the gate is slidably driven between positions through an operating shaft assembly rotatably mounted on the frame and including a conventional rack and pinion. As will be appreciated by those skilled in the art, opposite ends of the operating shaft assembly are engagable by a power driven tool to drive the gate between positions.

Existing unloading sites usually have two parallel and adjacent unloading pits that are about 36 to 40 feet in length and a yard having a capacity for storing in excess of 500 railroad hopper cars. The unloading area is typically sheltered from rain and snow and the railroad cars are spotted over the unloading pits by using two car pullers (one for each track). Locomotives are used to move the hopper cars into range of the spotters and the railroad hopper cars are usually stationary during the unloading process. When the slide gate mechanisms are opened, an operator is required to use one of three portable power drivers or tools to independently operate the sliding gate associated with each discharge opening on the railroad car. Preferably, the discharge of material from the hopper car is limited to between the tracks since any material dropped on the rails has the potential for causing a derailment and the discharged material will be contaminated.

Unloading of the railroad hopper cars involves three to four persons located between the two unloading pits. This arrangement allows access to both tracks from one location using three power driven tools. As will be appreciated by those skilled in the art, each power tool has a free end configured to interface with either end of the operating shaft assembly on the slidable gate. Each tool is configured to handle a specific style of gate or gate operating handle. It has also been found it takes approximately five to seven minutes to empty a standard size hopper car.

During unloading, a hatch on a top of the covered hopper car should be opened to equalize the pressure within the walled enclosure as the particulate matter or ballast passes therefrom. Although inconvenient, failure to open a hatch on the top of the hopper car can result in the car imploding during the unloading process.

As will be appreciated, unloading of covered hopper cars involves a manually intensive effort. Moreover, time is of the essence. In view of future demands, unloading sites are preparing for quicker and easier ways to unload the hopper cars and convey the particulate matter or ballast away from the unloading pits. Some sites are preparing their unloading procedures such that the hopper cars can be unloaded while on the move rather than remaining stationary.

Thus, there is a need and a desire for a door assembly for hopper cars which allows the particulate matter stored and transported within the walled enclosure of the hopper car to be discharged rapidly from the hopper cars and between the rails with minimum operator intervention.

SUMMARY OF THE INVENTION

In view of the above, a primary object of this invention is to provide a door assembly for a covered hopper which allows for rapid discharge of material held within a walled enclosure on the hopper car with minimal operator intervention. The hopper car is provided with an underframe extending longitudinally of the car. As is conventional, the underframe of the hopper car is supported, toward opposite ends thereof, by wheels which ride on rails or tracks. The door assembly of the present invention includes a plurality of longitudinally mounted discharge doors that are arranged in end-to-end relation across a bottom of the hopper car. Each door is movable between open and closed positions. The present invention further includes a door operating mechanism. A salient feature of the present invention being that the door operating mechanism includes a single actuator or driver for operating the plurality of discharge doors between their open and closed positions substantially simultaneously relative to each other.

In a preferred form of the invention, the discharge doors are longitudinally mounted in pairs to the underframe of the hopper car. That is, each pair of discharge doors includes doors mounted to opposite lateral sides of a longitudinal axis of the hopper car for controlling discharge of particulate matter from the hopper car as a function of their position. In the illustrated form of the invention, each door is pivotally mounted to the underframe of the hopper car. In a most preferred form of the invention, the door is pivotally mounted to the frame adjacent the longitudinal centerline of the hopper car thereby promoting the discharge pattern of particulate material to an area or pattern between the wheels of the hopper car and, thus, within the width of the tracks.

Each discharge door of the door assembly is preferably provided with seal structure. The seal structure on each door preferably extends about the periphery thereof and operates in combination with the hopper car to seal closed the discharge door when moved into a closed position thereby inhibiting moisture and debris from contaminating the ballast or particulate matter transported and held within the hopper car. In a preferred form of the invention, each discharge door is furthermore provided with a vertically upturned lip extending about the periphery of the discharge door to further enhance the sealing capability thereof while inhibiting moisture and debris from contaminating the ballast or particulate matter held and transported within the hopper car.

In a preferred form of the invention, the door operating mechanism includes an elongated actuating shaft extending generally parallel to the longitudinal axis of the hopper car. The actuating shaft is preferably mounted on the underframe of the hopper car for pivotal movement about a fixed axis. The actuating shaft is operably connected to the single driver or actuator of the door operating mechanism. In a most preferred form of the invention, the single driver or actuator of the door actuating mechanism includes a pneumatically operated cylinder carried on the hopper car.

In that form of the invention wherein the doors are mounted to opposite lateral sides of the longitudinal axis of the car, the door operating mechanism further includes linkages radially extending in opposite directions from the actuating shaft. As will be appreciated, the free end of each linkage is operably connected to a discharge door such that upon rocking movement of the actuating shaft, the discharge doors are conjointly moved in substantial unison relative to each other. In a most preferred form of the invention, the linkage for connecting the actuating shaft to each discharge door is configured as an overcenter mechanism to inhibit the discharge doors from inadvertently opening from a closed position. Moreover, a releasable lock is provided in combination with the single actuator or driver of the door actuating mechanism for inhibiting the discharge doors from inadvertently swinging open from their closed position.

The hopper car on which the door assembly is mounted is further provided with vent structure. Thus, and upon discharge of the particulate matter from the covered hopper car, ambient air is permitted to pass into the walled enclosure of the car to prevent imploding of the walls of the hopper car.

With the present invention, all the discharge doors on the hopper car can be opened at substantially the same time by the single actuator of the door operating mechanism thereby opening substantially the entire bottom of the hopper car so as to effect relatively rapid exhaust of the particulate matter from the hopper car. As mentioned above, emptying of a covered hopper car normally requires between five and ten minutes. With the present invention, the same covered hopper car is emptied on an average of every 30 to 45 seconds. Because the discharge doors are longitudinally mounted in a pattern extending generally parallel to the longitudinal axis of the hopper car, the walls the hopper car enclosure are advantageously modified to furthermore enhance the carrying capacity of the hopper car.

Once the discharge doors are opened, the single actuator of the door assembly preferably remains enabled, thus, maintaining the discharge doors in their open position. The discharge doors are moved to their closed position, the releasable lock, operable in combination with the door operating mechanism actuator, maintains the discharge doors in their closed position thereby guarding against inadvertent movement of the door to their open position. As discussed above, the overcenter design of the linkages associated with the door operating mechanism furthermore guards against inadvertent opening of the discharge doors from their closed position.

In addition to being faster at emptying the hopper car, the bottom dump door assembly of the present invention requires far less manual effort to empty the hopper car. That is, with the present invention, there is a single actuator or driver for conjointly operating all the discharge doors substantially simultaneously rather than requiring individual opening and closing of three separate slide doors. As will be appreciated, operating a single driver or actuator requires far less effort and time than independently having to open and close three separate doors.

To further control the discharge of material, the hopper car is preferably provided with deflectors extending longitudinally along opposite lateral sides of the car. In combination with the advantageous pivotal mounting of the discharge doors adjacent to the longitudinal centerline of the car, the purpose of the deflectors is to limit the particulate matter discharged from the hopper car to a relatively narrow pattern disposed between the laterally spaced wheels of the car. As such, the exposure of the rails to particulate matter is advantageously reduced thereby reducing the likelihood of an inadvertent derailment due to particulate matter lying on the tracks or rails. These and other objects, aims, and advantages of the present invention will become readily apparent from the following detailed description, the drawings and the appended claims.

BRIEF DESCRIPTION OF THE DRAWINGS

FIG. 9 is a perspective view of a portion of the linkage system forming part of the present invention;

FIG. 10 is an end elevational view of that portion of the linkage system illustrated in FIG. 9;

DETAILED DESCRIPTION OF THE INVENTION

Figure 2:
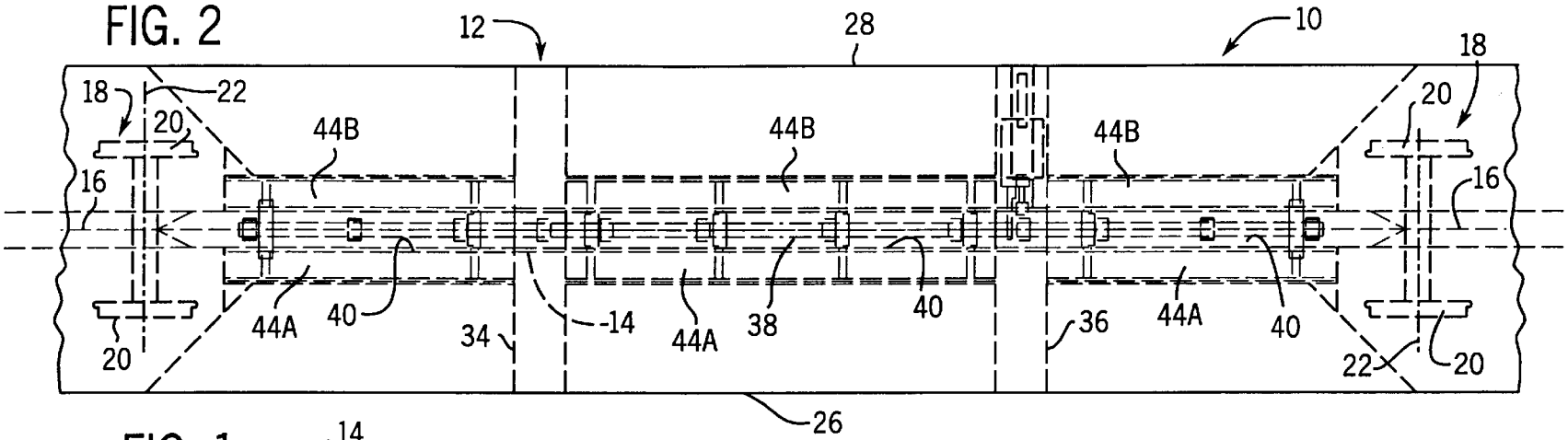
FIG. 2 is a top plan view of the hopper car illustrated in FIG. 1.

While the present invention is susceptible of embodiment in various forms, there is shown in the drawings and will, hereinafter be described a preferred embodiment of the invention with the understanding that the present disclosure is to be considered as setting forth an exemplification of the invention which is not intended to limit the invention to the specific embodiment illustrated.

Figure 1:
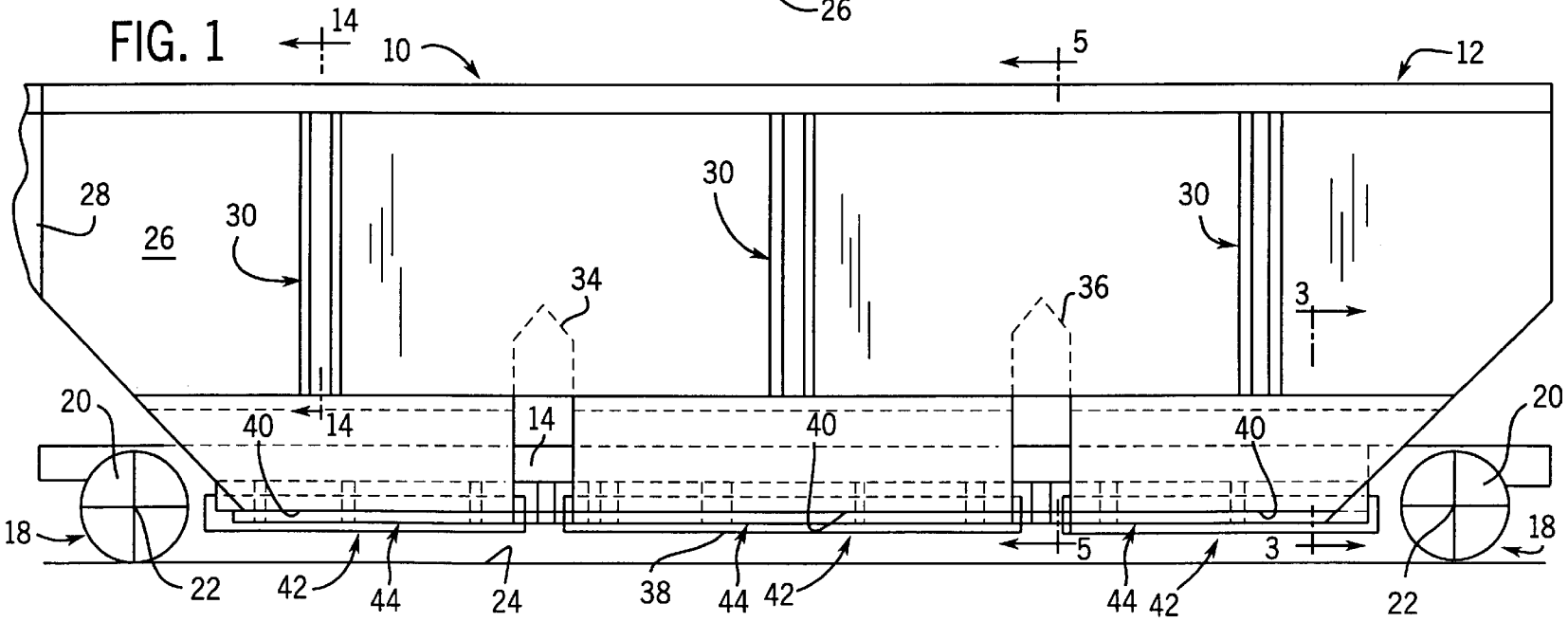
FIG. 1 is a side elevational view of a covered hopper car embodying features of the present invention.

Referring now to the drawings, wherein like reference numerals indicate like parts throughout the several views, a covered railroad hopper car, equipped with a door assembly according to the present invention, is somewhat diagrammatically illustrated in FIGS. 1 and 2. The covered railroad hopper car, generally designated by reference numeral 10, includes a multiwalled enclosure 12 for storing and transporting ballast or particulate matter therewithin. As is known in the art, the multiwalled enclosure 12 is supported on an underframe or center sill 14. The underframe 14 extends generally the length of and generally parallel to the longitudinal axis 16 of the car 10. As is typical, the underframe 14 is supported toward opposite ends thereof by conventional wheeled trucks, generally designated by reference numeral 18. As known in the art, each wheeled truck 18 preferably includes a pair of laterally spaced flanged wheels 20 which turn about an axis 22 extending transverse to the longitudinal axis 16 of the car 10 and which ride on laterally spaced tracks or rails 24.

Figure 5:
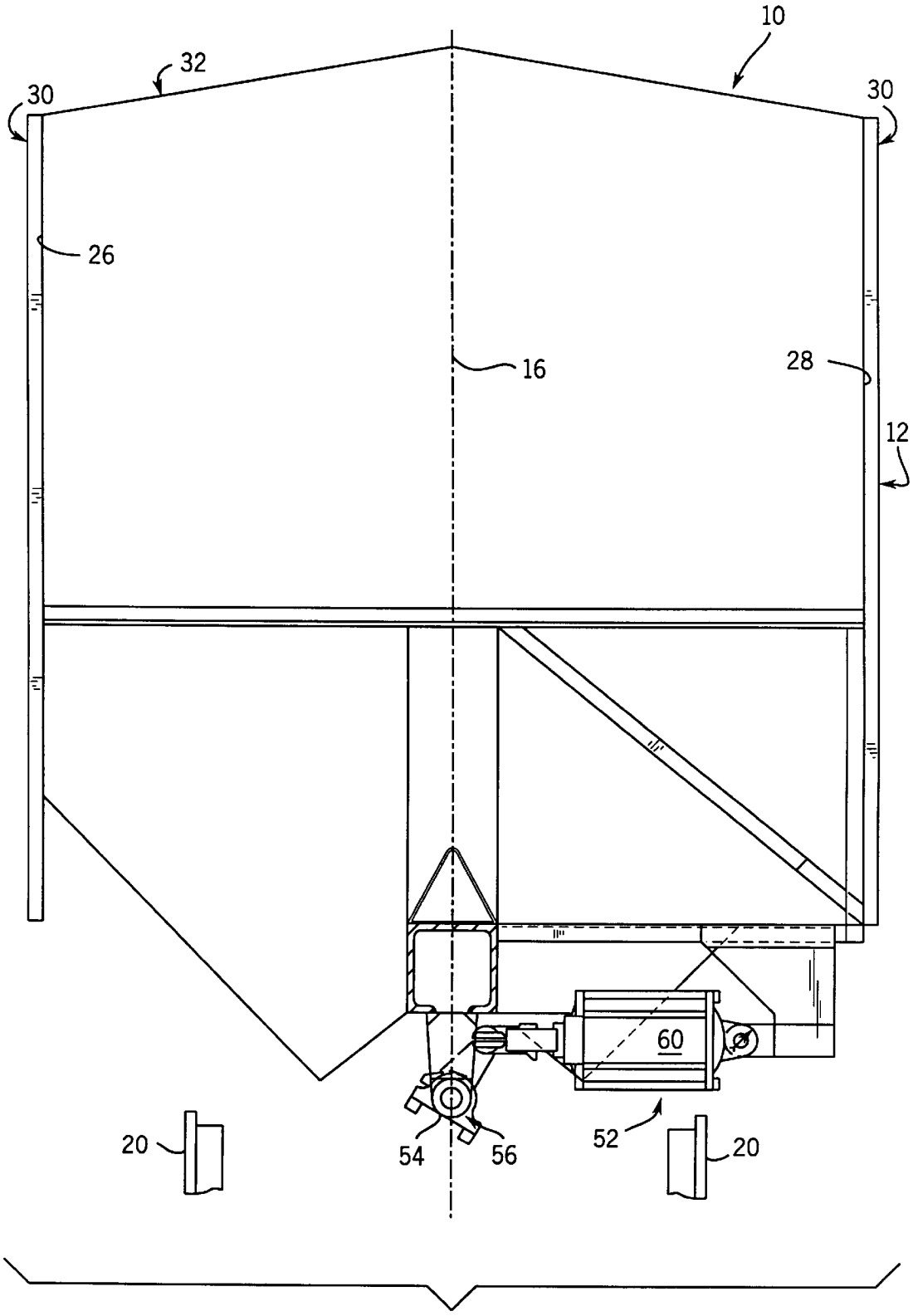
FIG. 5 is a sectional view taken along line 5—5 of FIG. 1.

As illustrated, the enclosure 12 has a generally rectangular configuration toward a top portion thereof and includes laterally spaced generally parallel side walls 26 and 28. As known in the art, a plurality of vertical side stakes or supports 30 are provided in combination with each side wall 26, 28 to add strength and rigidity thereto. As shown in FIG. 5, a roof 32 is provided in combination with and serves to cover the entire walled enclosure 12. As is conventional, the roof 32 is provided with one or more covered loading openings (not shown) of any suitable type. An interior of the hopper car enclosure 12 is divided transversely by the center sill 14 and furthermore by cross ridge partitions 34 and 36 (FIG. 1).

As illustrated in FIGS. 1 and 2, a bottom 38 of the enclosure 12 is provided with longitudinally elongated discharge openings 40 for allowing ballast or particulate matter to be discharged from the enclosure 12. In the illustrated embodiment of the invention, the longitudinally elongated discharge openings 40 are preferably arranged in pairs relative to each other on opposite lateral sides of the center sill or underframe 14.

Figure 3:
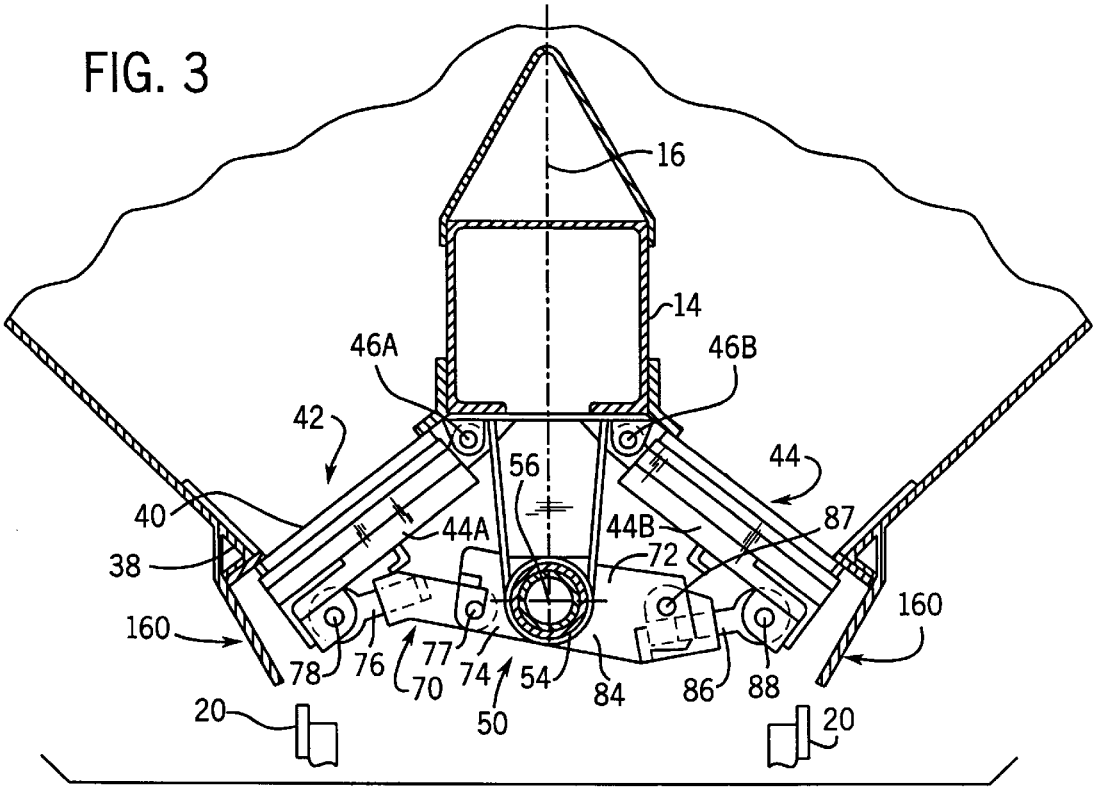
FIG. 3 is a sectional view taken along line 3—3 of FIG. 1 illustrating discharge doors of the present invention in a closed position.

According to the present invention, a door assembly, generally designated by reference numeral 42, is shown in FIGS. 1 and 3 in combination with the hopper car 10. As shown, the door assembly 42 includes a plurality of longitudinally mounted discharge doors 44 arranged in end-to-end relation across the bottom 38 of the hopper car enclosure 12 in relation to and for controlling the discharge of particulate matter or ballast through the discharge openings 40.

Figure 4:
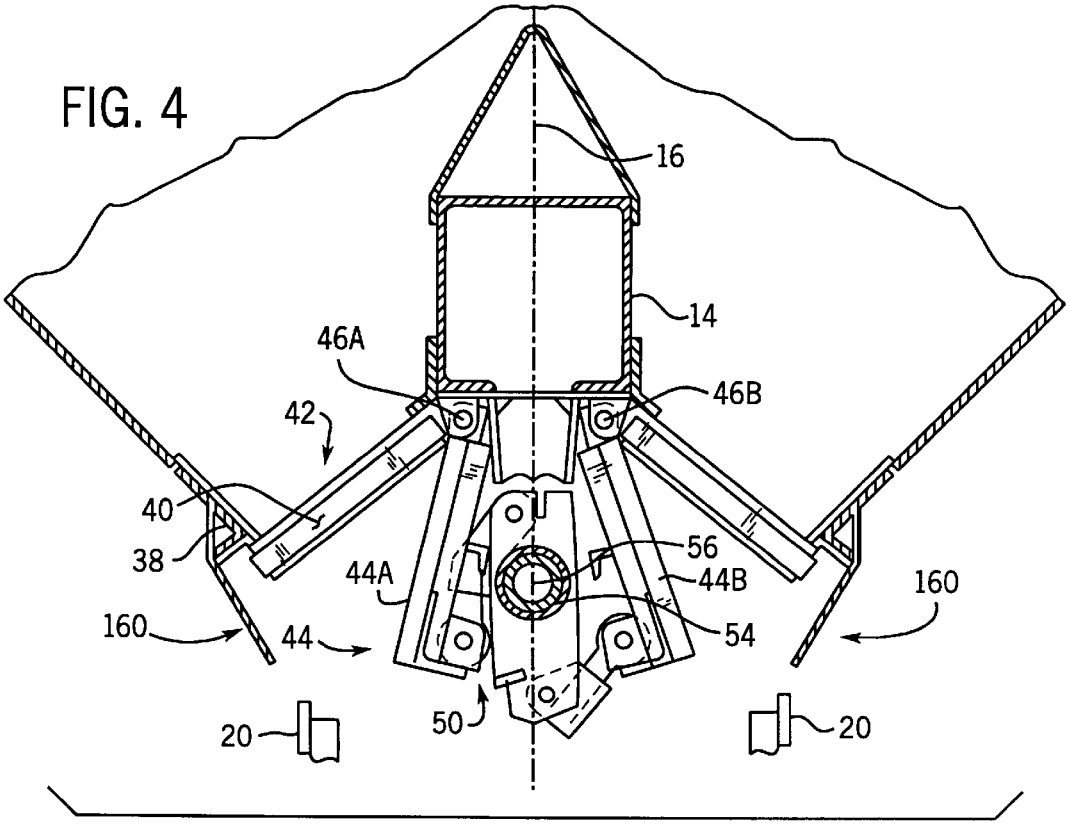
FIG. 4 is a sectional view similar to FIG. 3 but showing the discharge doors in an open position.

In a preferred form of the invention, and as shown in FIGS. 2, 3 and 4, the plurality of discharge doors 44 each preferably include divergently opening pairs of discharge doors 44A and 44B arranged on the hopper car 10 in opposed relation relative to each other. Each pair of doors 44A and 44B is mounted to the hopper car 10 for movement between a closed position (FIG. 3) and an open position (FIG. 4). As shown, each pair of doors 44A and 44B is preferably mounted to the underframe 14 adjacent the longitudinal centerline 16 of the car 10 for pivotal movement. As shown in FIGS. 3 and 4, each door 44A of the plurality of discharge doors 44 is mounted to the underframe 14 of hopper car 10 for pivotal movement about a generally horizontal axis 46A disposed generally parallel and adjacent to the longitudinal centerline 16 of the hopper car 10. Similarly, each door 44B of the plurality of discharge doors 44 is mounted to the underframe 14 of hopper car 10 for pivotal movement about a generally horizontal axis 46B disposed generally parallel and adjacent to the longitudinal centerline 16 of the hopper car 10.

The door assembly 42 of the present invention furthermore includes a door operating mechanism 50 for positively operating the discharge doors 44A and 44B of the plurality of discharge doors 44 in pairs between their open and closed positions. The door operating mechanism 50 includes a single positively powered driver or actuator 52 (FIG. 5) for positively and conjointly operating all the doors 44A and 44B of the plurality of discharge doors 44 substantially simultaneously relative to each other. The door operating mechanism 50 furthermore includes an elongated operating or actuation shaft 54 operably connected to the single driver or actuator 52 and to each pair of doors 44A and 44B of the plurality of discharge doors 44.

In the illustrated form of the invention, and as shown in FIGS. 3, 4 and 5, the actuating shaft 54 extends generally parallel to the longitudinal axis 16 of the hopper car 10. The actuating shaft 54 is preferably supported for rotational or rocking movement about a fixed axis 56 and is preferably supported by the underframe 14 of the hopper car 10. In a most preferred form of the invention, and to reduce its weight without effecting its strength or rigidity, the actuating shaft 54 preferably has a hollow or tubular configuration. Intermediate its ends, the actuating shaft 54 is operably coupled or connected to the actuator or driver 52.

Figure 6:
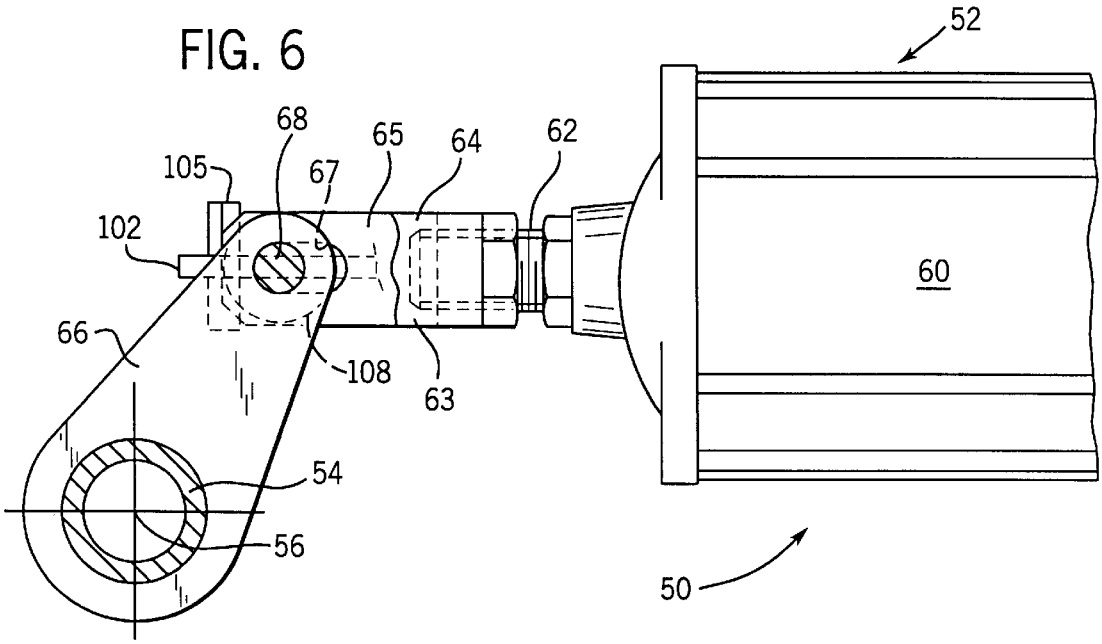
FIG. 6 is an enlarged end elevational view of a portion of a door operating mechanism of the present invention.
Figure 7:
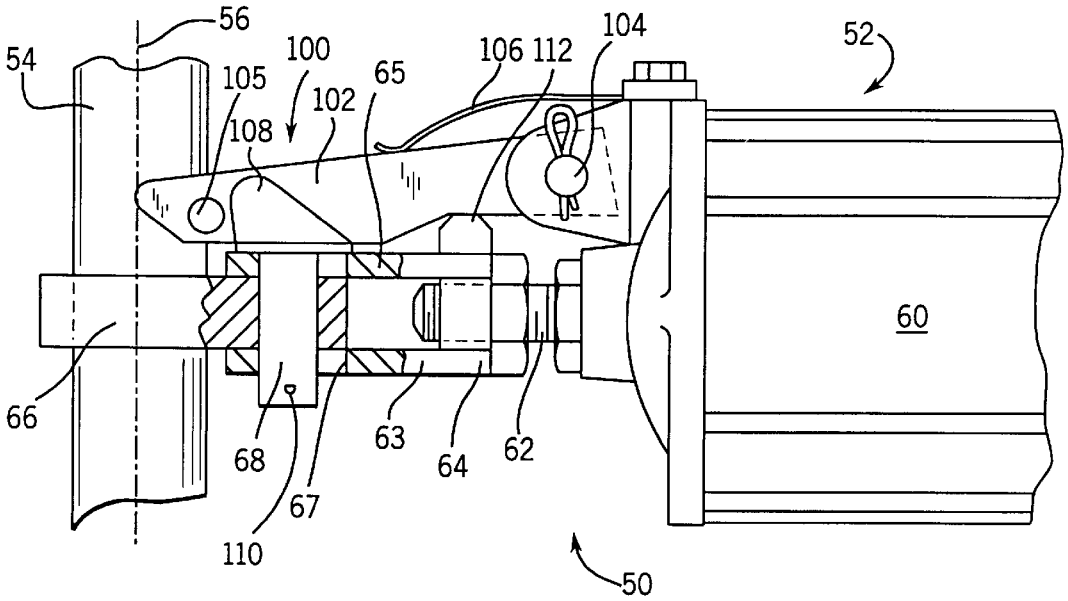
FIG. 7 is a top plan view of FIG. 6.

In the illustrated form of the invention, and as shown in FIGS. 6 and 7, the single powered driver or actuator 52 of the door operating mechanism 50 is preferably configured as a pneumatic cylinder 60 carried by the hopper car 10 (FIG. 5) and includes a piston rod 62 extending from one end of the cylinder 60. The piston rod 62 has a ram 64 fixed secured toward a distal end thereof. The ram 64 is preferably configured as a clevis with generally parallel and spaced arms 63 and 65. A lever or drive arm 66 radially extends outwardly from and is connected to the actuating shaft 54. The free end of the drive arm 66 is embraced on opposite sides by the arms 63 and 65 of ram 64. A pivot pin 68 serves to articulately interconnect the free end of the drive arm 66 to the ram 64 of actuator 52. Notably, the arms 63, 65 of ram 64 are each provided with an elongated slot 67 through which the pivot pin 68 passes thereby allowing for a predetermined degree or amount of lost motion as the pivot pin 68 traverses between opposite ends of the elongated slot 67 upon reciprocation of the ram 64. As will be appreciated, by this design, linear reciprocal movement of the piston rod 62 of driver 52 is converted to rocking movement of the actuating shaft 54 about axis 56.

Returning to FIG. 4, the door operating mechanism 50 furthermore includes a plurality of longitudinally spaced linkages 70 for operably interconnecting the actuating shaft 54 to each pair of doors 44A and 44B of the plurality of longitudinally spaced doors 44. Preferably, the linkages 70 for operably interconnecting the actuating shaft 54 to the discharge door 44A, 44B are substantially similar. Accordingly, only one linkage 70 will be described in detail with the other linkages being understood to be of substantially similar structure.

As shown in FIGS. 3 and 4, each linkage 70 preferably includes a bell crank lever 72 secured to and for rotation with the actuating shaft 54. Notably, the bell crank lever 72 is non-rotatably secured to the actuating shaft 54. As shown, the bell crank lever 72 includes a first radial arm 74 extending radially away from the actuating shaft 54 in a first direction, generally toward the discharge door 44A, and a second radial arm 84 extending radially away from the actuating shaft 54 in a second direction, opposed to said first direction, and generally toward the discharge door 44B. A first link 76 is articulately connected, as at 77, toward a distal end of radial arm 74 of the bell crank lever 72. An opposite end of the first link 76 is articulately connected, as at 78, to the discharge door 44A. Similarly, a second link 86 is articulately connected, as at 87, toward a distal end of radial arm 84 of the bell crank lever 72. An opposite end of the second link 86 is articulately connected, as at 88, to the discharge door 44B.

Figure 8:
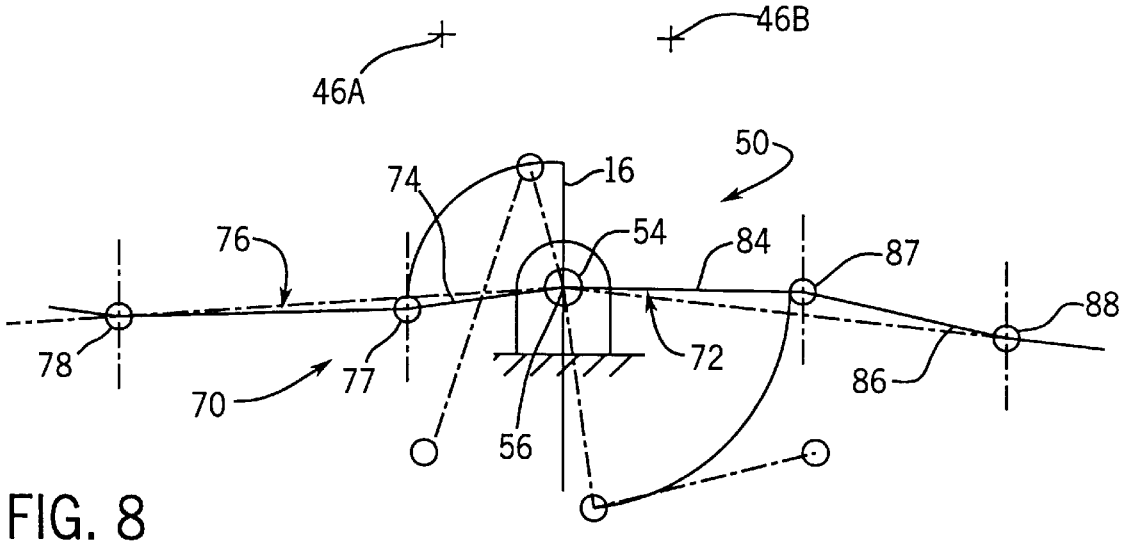
FIG. 8 is a schematic representation of a linkage system forming part of the door operating mechanism according to the present invention.

As schematically represented in FIG. 8, each linkage 70, including radial arms 74, 84 of bell crank lever 72, and the links 76, 86 leading therefrom, is preferably configured as an overcenter linkage mechanism. That is, the radial arms 74, 84 of bell crank lever 72 and links 76, 86 assume an overcenter position between the pivotal axis 56 of the actuating shaft 54 and the respective articulated connection 78, 88 to the discharge doors 44A and 44B to positively maintain the discharge doors 44A, 44B of the plurality of discharge doors 44 in a closed position. Notably, the articulate interconnections 77, 87 between the radial arms 74, 84 and their respective links 76, 86, respectively, are each required to move overcenter when the discharge doors 44A, 44B of the plurality of discharge doors 44 are to be moved from their closed position to their open position.

As will be appreciated by those skilled in the art, and except for the length thereof, the first and second links 76 and 86 of each linkage 70 are of substantially similar construction. Accordingly, only link 76 will be described in detail with the understanding link 86 is substantially similar thereto. As shown in FIGS. 9 and 10, link 76 preferably is of two piece rigid construction. That is, link 76 includes a first elongated lever or member 90 configured for pivotal attachment to one of the radial arms 74, 84 of the bell crank lever 72 (FIGS. 3, 4 and 8). At its opposite end, the lever or member 90 is preferably configured for attachment to an eye bolt 92 including a finely threaded shank 94 which is threadably accommodated within the free end of lever or member 90 to thereby shorten or lengthen link 76 as required and for purposes hereinafter described in detail. The opposite end of the eye bolt 92 is articulately or pivotally connected by a suitable fastener, as at 78, to a respective discharge door 44A, 44B of the plurality of discharge doors 44.

Returning to FIG. 7, in a preferred form of the invention, the door operating mechanism 50 furthermore includes a lock mechanism, generally designated by reference numeral 100, for releasably holding the pairs of doors 44A, 44B of the plurality of discharge doors 44 in their closed position. Preferably, the lock mechanism 100 is operable in combination with and is responsive to the single actuator 52 of the door operating mechanism 50.

The locking mechanism 100 shown in FIG. 7 preferably includes a lever 102 connected at one end to the actuator 52 for pivotal movement about a pin 104 carried by the pneumatic cylinder 60. The opposite end of the lever 102 is provided with a stop pin 105 arranged in transverse relation relative to the lever 102. A spring 106 serves to resiliently bias the lever 102 into the position illustrated in FIG. 7.

As shown, the pivot pin 68 for interconnecting the drive arm 62 radially extending from the actuating shaft 52 to the single actuator 52 of the door operating mechanism 50 includes an end cap 108 which straddles opposite sides of and releasably accommodates the pivotal lever 102. Notably, pivot pin 68 is maintained in place by a suitable retainer 110 arranged toward an end of the pin 68 opposite from the end cap 108. Moreover, the lock mechanism 100 includes a cam actuator 112 for properly positioning the lever 102 and the pivot pin 104 as a function of the operation of the actuator 52 of the door operating mechanism 50. In the illustrated form of lock mechanism 100, the cam actuator 112 operates in combination with an underside or surface on the lever 102.

Figure 11:
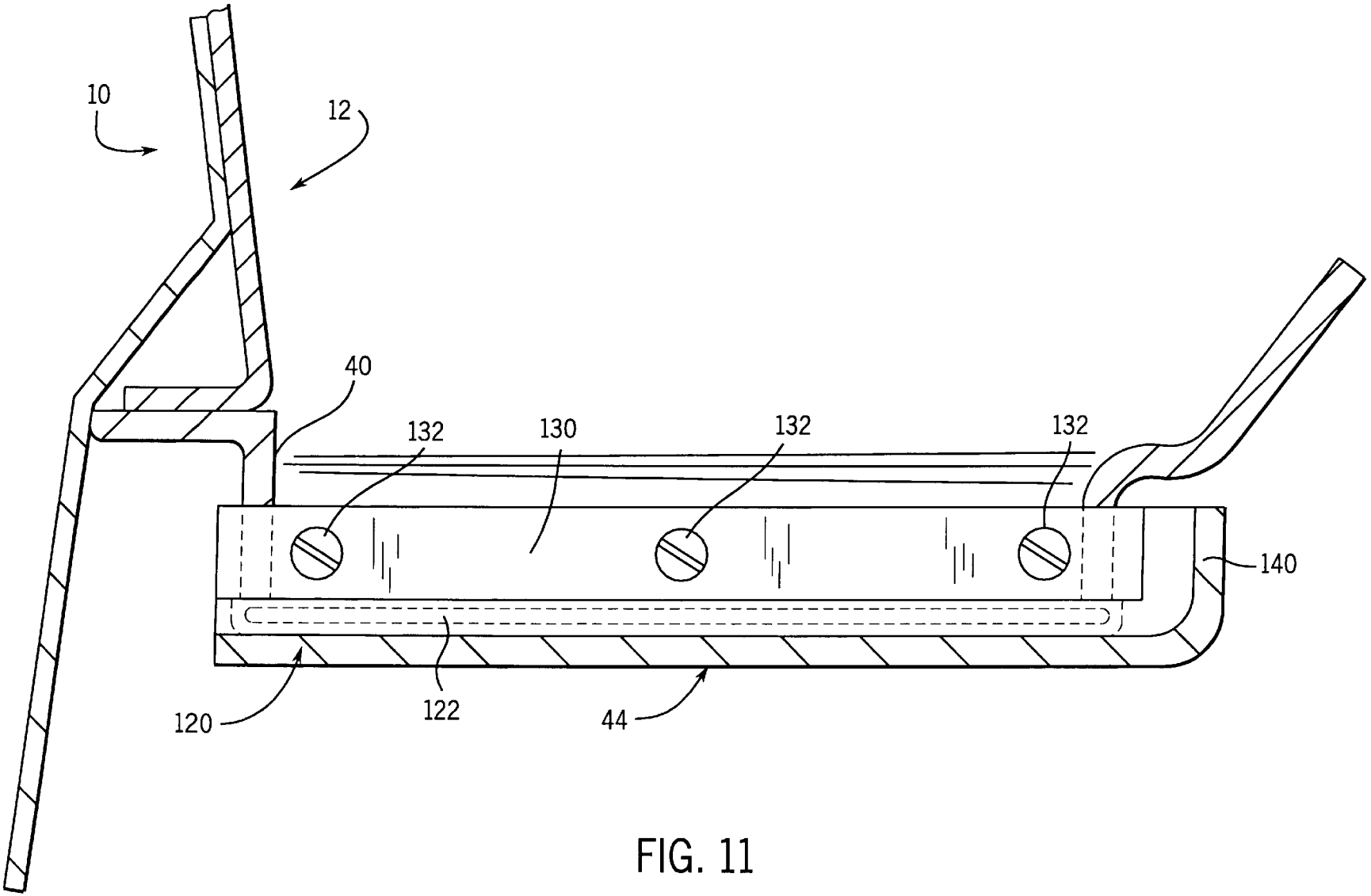
FIG. 11 is an enlarged end view of a discharge door of the present invention.
Figure 12:
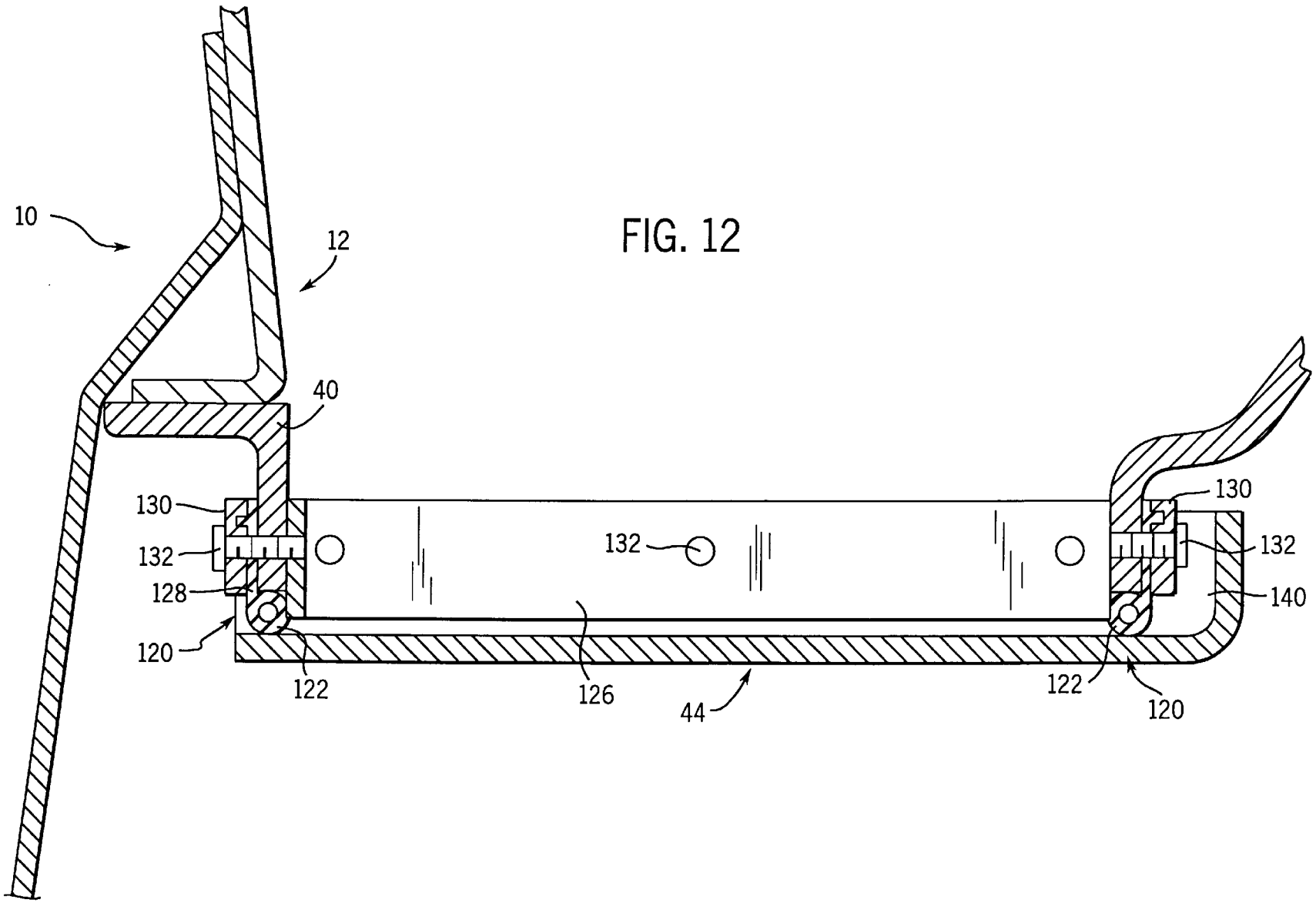
FIG. 12 is a view similar to FIG. 11 but showing certain parts in section to better appreciate and understand the preferred form of the present invention.

In a preferred form of the invention, each door 44A, 44B of the plurality of discharge doors 44 further includes seal structure, generally indicated by reference numeral 120, arranged about the periphery thereof for sealing closed a respective discharge door to the walled enclosure 12 of the hopper car 10. As shown in FIGS. 11 and 12, seal structure 120 includes a seal 122 mounted about the periphery of each discharge opening 40 defined by the walled enclosure 12 of hopper car 10. In a preferred form, the seal 122 is fabricated from a neoprene material having a durometer hardness of about 50 Shore A. In a most preferred form of the invention, the seal 122 has a hollow configuration to enhance its sealing capability and reduce damage thereto.

As illustrated in FIG. 12, seal 122 is preferably disposed beneath the walled enclosure 12 defining each discharge opening 40. To prevent the seal 122 from being crushed when the discharge door 44 is closed, seal structure 120 further includes an inner frame 126 fixedly connected to the interior of the discharge opening 40. The inner frame 126 is formed from a rigid material such as aluminum steel or the like. In the illustrated embodiment, and to facilitate its attachment to the walled enclosure, the inner frame 126 is of multi-piece construction.

Figure 13:
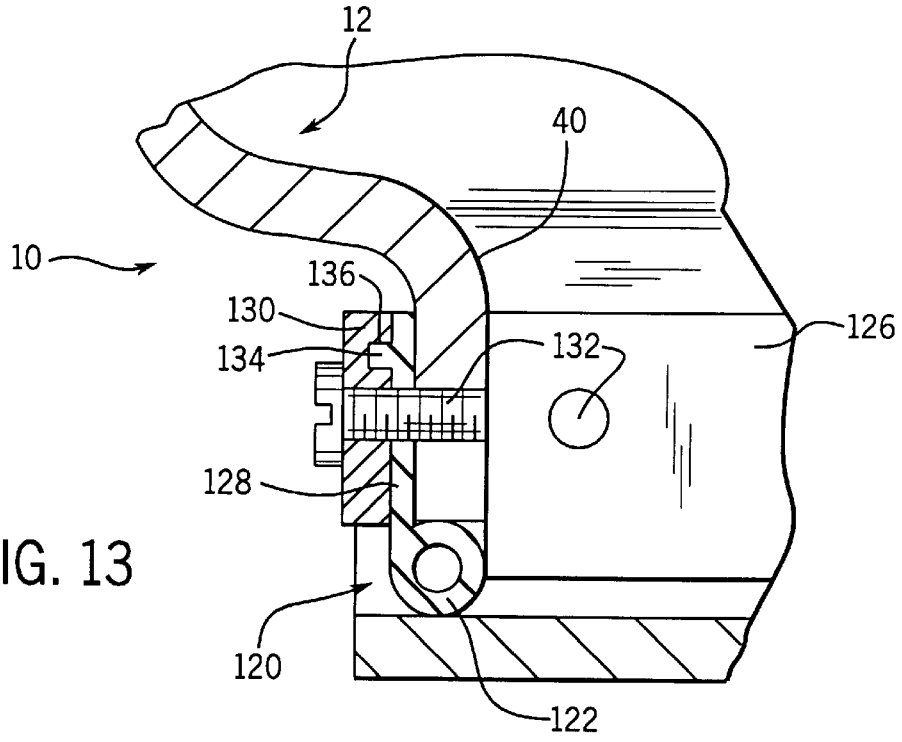
FIG. 13 is another enlarged view, partly in section, showing a portion of the sealing structure preferably associated with a discharge door of the present invention.

In the embodiment illustrated in FIGS. 12 and 13, seal 122 includes a mounting flange 128 flexibly connected to and radially extending therefrom. As shown, and when the seal 122 is attached to the walled enclosure 12 of the hopper car 10, the mounting flange 128 of seal 122 extends from the seal 122 and is clamped between the walled enclosure 12 of hopper car 10 and an outer clamp 130. The outer clamp 130 is preferably formed out of a rigid material such as steel or the like. In the illustrated form, a plurality of threaded fasteners 132 are used to conjointly secure the outer clamp 130 and the inner frame 126 to the walled enclosure 12 of hopper car 10 with the mounting flange 128 of seal 122 securely clamped therebetween.

In a most preferred form, and as shown in FIG. 13, the mounting flange 128 of seal 122 includes an outwardly projecting lip 134 extending longitudinally therealong. The outer clamp 130 of seal structure 120 is preferably provided with an open longitudinally extending channel 136 configured to accommodate and hold the longitudinally extending lip 134 of seal 122 therewithin. Accordingly, and when the seal 122 is secured to the walled enclosure 12 of hopper car 10 in relation to the discharge opening 40, the lip 134 of seal 122 and channel 136 on the outer clamp 130 cooperate relative to each other to inhibit the seal 122 from being inadvertently pulled or torn from about the discharge opening 40.

Another feature of the present invention relates to the design of the discharge doors 44A and 44B of the plurality of discharge doors 44. As shown in FIGS. 11 and 12, each discharge door 44A, 44B of the plurality of discharge doors 44 is preferably provided with a vertically upturned lip 140 extending about at least three sides of the respective door. As shown, the upturned lip 140 extends generally parallel and in spaced relation relative to the outer clamp 130 of the seal structure 120. The upturned lip 140 extends for a vertical distance sufficient to inhibit moisture and related debris from passing into the discharge opening 40 when the discharge door 44 is arranged in the closed position thereby inhibiting contamination of the ballast or particulate matter within the enclosure 12. Notably, that side or edge of the discharge door 44 extending parallel to and spaced the furthest distance from the axes 46A and 46B of each ot the doors 44A and 44B, respectively, of the plurality of discharge doors 44 preferably has no upturned lip to avoid interfering with the material flow from the discharge openings 40 when the discharge doors 44 are moved to an open position.

As will be appreciated by those skilled in the art, the longitudinal disposition of the discharge doors 44 allows the particulate matter or ballast to be rapidly discharged from the enclosure 12 after the discharge doors 44 are opened. As mentioned above, it is customary to open loading doors on the roof 32 of the enclosure 12 before the discharge doors 44 of the hopper car 10 are opened to effect pressure equalization within the enclosure 12. As will be appreciated, and for any of several reasons, the loading doors on the hopper car are not always opened before the discharge doors are opened. Thus, and notwithstanding the rigidity and support added to the enclosure 12 by the vertical stakes or supports 30, the side walls 26, 28 of the enclosure 12 tend to implode upon rapid discharge of material from the enclosure 12 of the hopper car 10.

Figure 15:
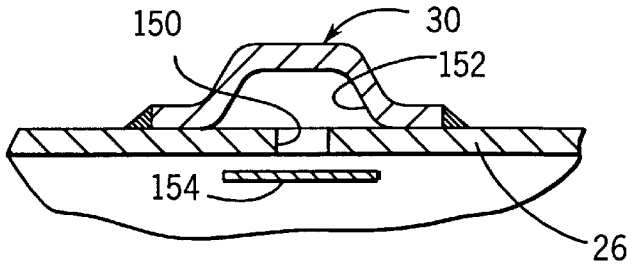
FIG. 15 is a sectional view taken along line 15—15 of FIG. 14.
Figure 14:
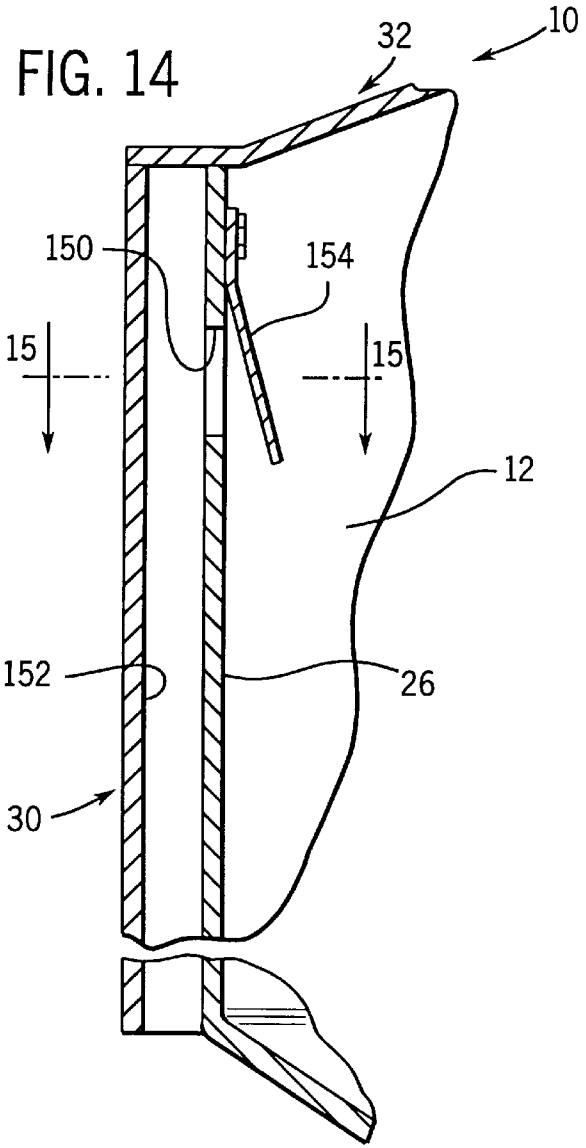
FIG. 14 is an enlarged sectional view taken along line 14—14 of FIG. 1.

Accordingly, the hopper car 10 is furthermore provided with a venting system for automatically effecting pressure equalization within the enclosure 12 of the hopper car 10 as a result of the discharge doors 44 being opened but requiring no operator intervention. In the preferred embodiment, and as shown in FIGS. 14 and 15, the venting system involves using one or more of the vertical stakes or supports 30 as an air plenum for directing ambient air to an inlet opening 150 arranged toward an upper end or top of the enclosure 12 of hopper car 10. Notably, and as shown, each stake or support 30 on opposite side walls 26, 28 of the enclosure 12, define an elongated channel 152 which, in the illustrated embodiment, is open at the bottom thereof. The open bottom end of the channel 152 permits ambient air to be drawn into the channel and toward the inlet opening 150. Moreover, a deflector 154 is provided on the interior of the walled enclosure 12 to cover the inlet opening 150 while allowing for air to be drawn into the enclosure 12 through the opening 150. As will be appreciated, the deflector 154 serves to inhibit particulate matter and material from inadvertently plugging the inlet opening 150 during loading of the hopper car 10.

Returning to FIGS. 3 and 4, the railroad hopper car 10 furthermore preferably includes deflectors 160 arranged longitudinally along opposed sides 26, 28 of the walled enclosure 12 (FIG. 1). The deflectors 160 act in conjunction with the discharge doors 44A, 44B of the plurality of discharge doors 44 for limiting the discharge pattern of particulate matter from the hopper car 10. More specifically, the deflectors 160 serve to limit the discharged ballast or particulate matter to a relatively narrow pattern disposed between the laterally spaced wheels 20 of each wheeled truck 18.

During unloading, a covered railroad hopper car 10 according to the present invention, is positioned along the tracks 24. Notably, the longitudinal disposition of the discharge doors 44 along the bottom 38 of the car eliminates many of the slope sheets and slanted walls normally provided on such hopper cars and leading from the discharge openings along the bottom of the car. Thus, by arranging the plurality of discharge doors 44 longitudinally of the car, the carrying capacity of the walled enclosure 12 is advantageously and significantly increased as compared to traditionally styled covered railroad hopper cars.

Once the railroad hopper car 10 is properly positioned along the tracks 24 for discharge, the door operating mechanism 50 is enabled through any suitable switch or the like (not shown) operably associated therewith. With the disclosed embodiment of the invention, when the door operating mechanism 50 is enabled, the single driver or actuator 52 is powered to cause the piston rod 62 and the ram 64 associated therewith to linearly distend outwardly away from the cylinder 60. As mentioned above, the linear displacement of the piston rod 62 is converted to rotary or pivotal movement of the actuating shaft or member 54 about axis 56.

As best illustrated in FIG. 7, as the piston rod 62 and ram 64 linearly move away from the cylinder 60, the cam actuator 112 on the lock mechanism 100 will contact the underside of lever 102. As linear movement of the ram 64 continues, the camming action of the actuator 112 on lever 102 will cause the lock lever 102 to pivot and lift about pin 104 against the action of spring 106 thereby lifting or removing the stop pin 105 from engagement with and from the path of travel of the end cap 108 of pivot pin 68 connecting the ram 64 to the actuating lever 66 of the door operating mechanism 50. As will be appreciated by those skilled in the art, in a preferred form, the cam actuator 112 is arranged relative to the underside of the lever 102 such that after the pivot pin 68 traverses the full length of the elongated slot 67 in the ram 64, the locking lever 102 and stop pin 105 are removed from interfering with or otherwise encumbering arcuate movement of the actuating lever 66. That is, the lost motion associated with the lock mechanism 100 through the elongated slot 67 in ram 64 assures the lock mechanism 100 is released in timed relation and, more specifically, prior to movement of the actuating arm or lever 66 in a direction to open the plurality of discharge doors 44.

As will be appreciated from FIGS. 3, 4 and 8, rotation of the actuating shaft 54, resulting from arcuate movement of the actuating lever 64 about axis 56, results in all of the pairs of discharge doors 44A, 44B in the plurality of discharge doors 44 being opened substantially simultaneously to exhaust the particulate matter from the enclosure 12. That is, rather than requiring operators to have to incur three or more separate operations on three or more different discharge doors, the door operating mechanism 50 conjointly opens all three longitudinally spaced and elongated discharge doors 44 at substantially the same time. Thus, substantially the entire bottom 38 of the hopper car 10 is opened at once to permit rapid discharge of material from the enclosure 12. As mentioned above, the entire contents of the hopper car 10, even though significantly increased as a result of the advantageous car design promoted by the longitudinal arrangement of the discharge doors 44, is exhausted in about one-quarter of the time previously required to empty a covered hopper car with less capacity than that afforded by the advantageous design of the present invention. As will be appreciated from an understanding of the present invention, and in addition to being faster than heretofore known designs, the bottom dump door assembly 50 of the present invention advantageously requires far less manual efforts to empty the car 10.

As shown in FIG. 8, rotation of the actuating shaft 54 about axis 56 as a result of actuation of the single powered driver 52 (FIGS. 6 and 7) produces simultaneous rotation of all the bell crank levers 72 of the linkages 70. As each bell crank lever 72 rotates about axis 56, the links 76, 86 of linkages are moved out of their overcenter locking disposition and move toward the dotted line positions shown in FIG. 8. Accordingly, each pair of discharge doors 44A. 44B of the plurality of discharge doors 44 are pivotally moved about their respective pivot axis 46A and 46B arranged adjacent the longitudinal centerline 16 of the hopper car 10. In a preferred embodiment, the driver 52 of the door operating mechanism 50 remains powered during unloading of the car 10 to assure the discharge doors remain in their open position.

The venting system associated with the hopper car 10 is configured to prevent the walls of the enclosure 10 from imploding during rapid discharge of material from the hopper car 10. As will be appreciated by those skilled in the art, and as a result of the provision of the venting system, during unloading of the hopper car 10 ambient air is drawn through the channels 152 defined by the supports 30 and is introduced toward an upper end of the car 10 through the inlet ports 150 to effect pressure equalization in the enclosure 12. The deflectors 154 arranged across the inlet ports 140, while freely allowing ambient air to be introduced toward an upper end of the car 10, inhibit plugging of the inlet ports 150 during loading of the car 10 as through the roof 32.

In addition to effecting rapid discharge of material from the hopper car 10 with minimal operator intervention, controlling the discharge of particulate matter from the hopper car 10 is also an important concern during the unloading process. As mentioned above, controlling the discharge of material to a limited area preferably extending between the wheels 20 and tracks 24 is an advantageous objective of the present invention. In this regard, having the pairs of discharge doors 44A and 44B of the plurality of discharge doors 44 pivot adjacent to the longitudinal axis 16 of the hopper car 10 advantageously limits the discharge pattern of the particulate matter to an area between the rails 24. In a preferred form, the deflectors 160 arranged along opposed sides of the railcar 10 combine with the discharge doors 44 to furthermore limit the pattern of particulate matter discharged from the car 10 to a relatively narrow area between the laterally spaced wheels 20 of each wheeled truck 18. As such, the exposure of the tracks or rails 24 to particulate matter is reduced thereby reducing the likelihood of an inadvertent derailment due to particulate matter contamination of the rails 24. Moreover, the upturned lips 140 arranged about the periphery of each pair of discharge doors 44A, 44B of the plurality of discharge doors 44 furthermore adds a degree of control to the material flowing from the car 10.

After the discharge of matter from the car 10 is completed, the single powered actuator 52 of the door operating mechanism 50 is operated to retract the ram 64 thereby forcibly pulling the actuating lever 66 toward a closed position. Of course, pulling the actuating lever 66 causes the actuating shaft 54 to rotate about axis 56 in a direction causing the linkages 70 to close the discharge doors 44. Notably, and as shown best in FIG. 8, links 76, 86 of each linkage 70 are returned to an overcenter position when the discharge doors 44 are closed thereby reducing the likelihood of the discharge doors 44 inadvertently opening from a closed position.

On the return stroke of the pneumatic cylinder 60, the elongated slot 67 of the ram 64 will traverse across the pivot pin 68 of the actuating lever 66 in a lost motion movement and until the pivot pin 68 is constrained by an opposite end of the slot 67 at which time, the actuating lever 66, te pivot pin 68 and ram 64 will move in unison relative to each other. As such, and because the cam actuator 112 is retracted from engaging the underside of the stop lever 102, the spring 106 serves to move the lever 102 into the position shown in FIG. 6 whereby the stop pin 105 is in a position to be engaged by the end cap 108 on pivot pin 68 thereby inhibiting the discharge doors 44 from moving toward their open position. Accordingly, the lock mechanism 100 serves to releasably maintain the discharge doors 44 in a closed position. Thus, the power to the single powered actuator 52 of the door operating mechanism can be shut off without concern of the discharge doors moving toward an open position from their closed position.

When the discharge doors 44 are in their closed position, the doors 44 press against the seal structure 120 to preferably seal the discharge doors 44 to the enclosure 12. As will be appreciated by those skilled in the art, the threaded connection between the radial arms 74, 84 of each bell crank lever 72 of the linkages 70 and the finely threaded shank portion 94 on the levers 90 of each linkage 70 of the door operating mechanism 50 permits accurate and fine adjustment of the closing or sealing force applied by each discharge door 4 against the seal structure 120. In the illustrated embodiment, the hollow configuration of the seal 122 furthermore enhances the performance of seal structure 120. Moreover, the inner frame 126 of seal structure 120 limits overcompression of the seal 122 and thereby prolongs its usefulness. Additionally, clamping the flange 128 of seal 122 with the outer clamp 130 and to the walled enclosure 12 inhibits the seal 122 from being torn or ripped from the enclosure 12. As will, be appreciated, the upturned lip 140 extending about the peripheral edge of the discharge doors 44 furthermore inhibits moisture and debris from contaminating the ballast or particulate matter within the enclosure 12 of the covered hopper car 10 when the discharge doors 44 are in closed position.

From the foregoing, it will be observed that numerous modifications and variations can be effected without departing from the true spirit and scope of the novel concept of the present invention. It will be appreciated that the present disclosure is intended to set forth an exemplification of the invention, which is not intended to limit the invention to the specific embodiment illustrated and described. The disclosure is intended to cover by the appended claims all such modifications as fall within the spirit and scope of the claims.

What is claimed is:

1. A door assembly for a bottom dump covered railroad hopper car having an underframe including a centersill defining a longitudinal axis for the railroad car and a plurality of longitudinally spaced discharge openings, said door assembly comprising:

a plurality of longitudinally mounted, divergently opening pairs of discharge doors, with each pair of discharge doors being mounted in end-to-end spaced relation relative to an adjacent pair of discharge doors and relative to said longitudinally spaced discharge openings defined along a bottom of the hopper car, with each discharge door being mounted for pivotal movement between open and closed positions about an axis arranged adjacent and extending generally parallel to the longitudinal axis of said centersill; and a door operating mechanism having a single powered driver for operating said plurality of pairs of discharge door simultaneously relative to each other thereby permitting bulk commodity within said hopper car to be rapidly discharged therefrom.

2. The door assembly according to claim 1 further including seal structure associated with each discharge door of each pair of said plurality of discharge doors for sealing closed a respective discharge opening in said hopper car when said discharge door is in the closed position.

3. The door assembly according to claim 1 wherein each discharge door in each pair of said plurality of pairs of discharge doors includes a vertically upturned lip extending about the periphery thereof for inhibiting moisture and debris from passing into a respective discharge opening defined by said hopper car thereby inhibiting contamination of the ballast being stored and transported within said hopper car.

4. The door assembly according to claim 1 wherein said door operating mechanism includes an elongated actuating shaft extending generally parallel to the longitudinal axis of said hopper car and which is operably connected to said single powered driver, said actuating shaft being mounted on the underframe of said hopper car for pivotal movement about a fixed axis.

5. The door assembly according to claim 4 wherein the discharge doors of each pair of discharge doors of said plurality of discharge doors is pivotally mounted to the underframe of the hopper car on opposite lateral sides of the fixed axis of said actuating shaft.

6. The door assembly according to claim 5 wherein each discharge door of each pair of discharge doors is connected to said actuating shaft by a linkage mechanism radially extending outwardly from said actuating shaft.

7. The door assembly according to claim 6 wherein said linkage mechanism is configured as an overcenter mechanism to inhibit the discharge doors in said plurality of pairs of discharge doors from inadvertently opening from the closed position.

8. The door assembly according to claim 1 wherein said operating mechanism further includes a lock for releasably holding the discharge doors of said plurality of pairs of discharge doors in the closed position.

9. A door assembly for a bottom dump covered railroad hopper car having an underframe including a centersill defining a longitudinal axis for the hopper car, said door assembly comprising:

a plurality of longitudinally mounted discharge doors arranged in end-to-end relation across a bottom of said railroad car, with each door being movable between open and closed positions along an axis disposed adjacent and generally parallel to the longitudinal axis of said centersill; and a door operating mechanism having a single positively powered actuator for operating said plurality of discharge doors between their open and closed positions simultaneously relative to each other.

10. The door assembly according to claim 9 wherein each of said discharge doors is provided with seal structure extending about the periphery thereof.

11. The door assembly according to claim 9 wherein each of said discharge doors is provided with an upturned lip extending about the periphery thereof for inhibiting moisture and debris from moving past said discharge door.

12. The door assembly according to claim 9 wherein each of said discharge doors is pivotally mounted to the underframe of said hopper car.

13. The door assembly according to claim 9 wherein said door operating mechanism includes an elongated actuating shaft carried by said underframe of the hopper car for pivotal rocking movement about a fixed axis extending generally parallel to the longitudinal axis of said hopper car.

14. The door assembly according to claim 13 wherein said door operating mechanism further includes linkages for operably connecting said actuating shaft to each of the discharge doors of said door assembly.

15. The door assembly according to claim 14 wherein said linkages are configured as overcenter linkages such that when said discharge doors are in the closed position, the overcenter design of the linkages inhibits inadvertent opening of the discharge doors.

16. The door assembly according to claim 13 wherein said discharge doors are each mounted in opposed relation relative to each other and on opposite lateral sides of the fixed axis of said actuating shaft.

17. The door assembly according to claim 16 wherein said door operating mechanism further includes linkages radially extending in opposite directions from said actuating shaft for interconnecting the doors on opposite lateral sides of the fixed axis of said actuating shaft to said actuating shaft.

18. The door assembly according to claim 17 wherein said linkages have an overcenter design to inhibit said doors from inadvertently opening from their closed position.

19. The door assembly according to claim 9 wherein said door operating mechanism further includes a releasable lock for maintaining said doors in their closed position.

20. A covered railroad hopper car comprising:

a longitudinally extending underframe including a centersill defining a longitudinal axis for the hopper car;

a walled enclosure carried by said underframe and wherein particulate matter is transported and held, said walled enclosure defining a plurality of longitudinally spaced discharge openings extending along a bottom of the hopper car for permitting discharge of particulate matter therethrough;

a plurality of longitudinally mounted discharge doors arranged in combination with said walled enclosure and in relation relative to said discharge openings to control the discharge of matter from the car as a function of the position of said doors between open and closed positions, with each discharge door being pivotally mounted for movements between the open and closed positions about an axis arranged adjacent and generally parallel to the longitudinal axis of said hopper car; and a door operating mechanism including a single positively powered actuator for conjointly operating said discharge doors between open and closed positions relative to each other thereby permitting all the discharge doors to be opened at the same time thereby opening substantially the entire bottom of the hopper car whereby permitting rapid exhaust of the particulate matter from the hopper car.

21. The hopper car according to claim 20 wherein each discharge door includes seal structure for sealing closed a respective discharge opening in the walled structure when said door is moved to the closed position.

22. A covered railroad hopper car comprising:

a longitudinally extending underframe;

a walled enclosure carried by said underframe and wherein particulate matter is transported and held, said walled enclosure defining a plurality of longitudinally spaced discharge openings extending along a bottom of the hopper car for permitting discharge of particulate matter therethrough;

a plurality of longitudinally mounted discharge doors pivotally arranged in combination with said walled enclosure and in relation relative to said discharge openings to control the discharge of matter from the car as a function of the position of said doors between open and closed positions, wherein said discharge doors are mounted to the underframe of sais hopper car in pairs, with each pair comprising a discharge door arranged on opposite lateral sides of a longitudinal centerline of said underframe; and a door operating mechanism including a single positively powered actuator for conjointly operating said discharge doors between open and closed positions relative to each other thereby permitting all the discharge doors to be opened at substantially the same time thereby opening substantially the entire bottom of the hopper car whereby permitting rapid exhaust of the particulate matter from the hopper car.

23. The hopper car according to claim 22 wherein said door operating mechanism includes an elongated actuating shaft extending generally parallel to a longitudinal axis of said hopper car and which is operably connected to said single actuator, said actuating shaft being mounted on the underframe of said hopper car for pivotal movement about a fixed axis.

24. The hopper car according to claim 22 wherein each discharge door in a pair of discharge doors is connected to said actuating shaft by a linkage mechanism radially extending outwardly from said actuating shaft.

25. The hopper car according to claim 24 wherein said linkage mechanism is configured as an overcenter mechanism to inhibit the discharge doors from inadvertently opening from the closed position.

26. The hopper car according to claim 20 wherein said single actuator includes a pneumatically operated cylinder mounted on said hopper car.

27. The hopper car according to claim 20 wherein said door operating mechanism further includes a lock mechanism for releasably holding said discharge doors in the closed position.

28. The hopper car according to claim 27 wherein said lock mechanism operates in combination with and is responsive to operation of said single actuator.

29. The hopper car according to claim 20 further including a vent for permitting ambient air to be drawn into the walled enclosure during discharge of particulate matter from the hopper car thereby reducing the likelihood the walled enclosure will implode during unloading of the particulate matter from the hopper car.

30. A covered railroad hopper car, comprising:

a longitudinally extending underframe supported toward opposite end by pairs of laterally spaced wheels, each pair of wheels being rotatable about an axis extending generally normal to a longitudinal axis of said underframe;

a walled enclosure carried by said underframe and wherein particulate matter is transported and held, said walled enclosure defining a plurality ot longitudinally spaced discharge openings extending along a bottom of the hopper car for permitting discharge of particulate matter therethrough;

a plurality of longitudinally mounted discharge doors pivotally arranged on opposite lateral sides of a longitudinal axis of said hopper car and in combination with said walled enclosure and in relation relative to said discharge openings to control the discharge of matter from the car as a function of the position of said doors between open and closed positions; and a door operating mechanism including a single powered actuator for conjointly operating said discharge doors between open and closed positions relative to each other; and deflectors arranged along opposed sides of said walled enclosure for limiting the particulate matter discharged from said hopper car to a relatively narrow pattern disposed between said lateral spaced wheels.

31. The hopper car according to claim 30 wherein said door operating mechanism includes an elongated actuating shaft extending generally parallel to a longitudinal axis of said hopper car and which is operably connected to said single actuator, said actuating shaft being mounted on the underframe of said hopper car for pivotal movement about a fixed axis.

32. The hopper car according to claim 31 wherein each discharge door in a pair of discharge doors is connected to said actuating shaft by a linkage mechanism radially extending outwardly from said actuating shaft.

33. The hopper car according to claim 32 wherein said linkage mechanism is configured as an overcenter mechanism to inhibit the discharge doors from inadvertently opening from the closed position.

34. The hopper car according to claim 30 wherein said single actuator includes a pneumatically operated cylinder mounted on said hopper car.

35. The hopper car according to claim 30 wherein said door operating mechanism further includes a lock mechanism for releasably holding said discharge doors in the closed position.

36. The hopper car according to claim 35 wherein said lock mechanism operates in combination with and is responsive to operation of said single actuator.

37. The hopper car according to claim 30 wherein said walled enclosure is vented to permit ambient air from outside said walled enclosure to be drawn into the walled enclosure during discharge of particulate matter from the hopper car thereby reducing the likelihood the walled enclosure will implode during unloading of the particulate matter from the hopper car.

* * * * *